US010190583B2

(12) United States Patent
Jaeger et al.

(10) Patent No.: US 10,190,583 B2
(45) Date of Patent: Jan. 29, 2019

(54) POSITIVE DISPLACEMENT PUMP

(71) Applicant: MHWIRTH GMBH, Erkelenz (DE)

(72) Inventors: Norbert Jaeger, Heinsberg (DE); Andreas Karwowski, Cologne (DE)

(73) Assignee: MHWIRTH GMBH, Erkelenz (DE)

( * ) Notice: Subject to any disclaimer, the term of this patent is extended or adjusted under 35 U.S.C. 154(b) by 222 days.

(21) Appl. No.: 14/910,258

(22) PCT Filed: Jul. 2, 2014

(86) PCT No.: PCT/EP2014/064070
§ 371 (c)(1),
(2) Date: Feb. 5, 2016

(87) PCT Pub. No.: WO2015/018570
PCT Pub. Date: Feb. 12, 2015

(65) Prior Publication Data

US 2016/0177946 A1 Jun. 23, 2016

(30) Foreign Application Priority Data

Aug. 9, 2013 (DE) ..... 10 2013 108 672

(51) Int. Cl.
*F04B 53/22* (2006.01)
*F04B 53/10* (2006.01)
(Continued)

(52) U.S. Cl.
CPC ..... *F04B 53/22* (2013.01); *F04B 43/0054* (2013.01); *F04B 43/067* (2013.01); *F04B 53/10* (2013.01); *F04B 53/16* (2013.01)

(58) Field of Classification Search
CPC ..... F04B 43/067; F04B 53/22; F04B 53/10; F04B 53/16; F04B 43/084
(Continued)

(56) References Cited

U.S. PATENT DOCUMENTS 4,471,799 A * 9/1984 Buck ..... F16K 27/02 137/315.11
4,491,345 A * 1/1985 Regan ..... E21B 33/038 285/18
(Continued)

FOREIGN PATENT DOCUMENTS

CN 202690386 U 1/2013
DE 1 528 456 A1 9/1970
(Continued)

OTHER PUBLICATIONS

Hose-Diaphagm Pumps, Feluwa, pp. 4 and 21, Obtained Nov. 7, 2017.*
English Translation of WO 2012/11957 obtained Oct. 31, 2017.*

*Primary Examiner* — Essama Omgba
*Assistant Examiner* — Connor Tremarche
(74) *Attorney, Agent, or Firm* — Norman B. Thot

(57) ABSTRACT

A positive displacement pump includes a drive unit and a pump unit. The pump unit comprises at least one inline valve unit, a connecting and/or spacing device, and a pair of flanges which are connected to each other via the connecting and/or spacing device. In an operating position, the at least one inline valve unit is clamped between the pair of flanges. The at least one inline valve unit is configured to be displaced without removing the connecting and/or spacing device.

11 Claims, 7 Drawing Sheets

(51) Int. Cl.
*F04B 53/16* (2006.01)
*F04B 43/067* (2006.01)
*F04B 43/00* (2006.01)

(58) Field of Classification Search
USPC ..... 417/454; 211/107, 1.3
See application file for complete search history.

(56) References Cited

U.S. PATENT DOCUMENTS

| | | | | |
|---|---|---|---|---|
| 4,619,589 | A | 10/1986 | Müller et al. | |
| 6,988,626 | B2 * | 1/2006 | Varghese | G06F 1/16 211/131.1 |
| 2003/0032506 | A1 * | 2/2003 | Chi | A63B 69/0002 473/417 |
| 2012/0288387 | A1 | 11/2012 | Freed et al. | |
| 2014/0248160 | A1 | 9/2014 | Giessbach et al. | |

FOREIGN PATENT DOCUMENTS

| | | | | |
|---|---|---|---|---|
| DE | 10 2011 001 087 | A1 | 9/2012 | |
| EP | 0 175 105 | A1 | 3/1986 | |
| WO | WO 2012119597 | A1 * | 9/2012 | F04B 43/084 |
| WO | WO 2013/045598 | A2 | 4/2013 | |

* cited by examiner

POSITIVE DISPLACEMENT PUMP

CROSS REFERENCE TO PRIOR APPLICATIONS

This application is a U.S. National Phase application under 35 U.S.C. § 371 of International Application No. PCT/EP2014/064070, filed on Jul. 2, 2014 and which claims benefit to German Patent Application No. 10 2013 108 672.1, filed on Aug. 9, 2013. The International Application was published in German on Feb. 12, 2015 as WO 2015/018570 A1 under PCT Article 21(2).

FIELD

The present invention relates to a positive displacement pump having a drive unit and a pump unit.

BACKGROUND

Many embodiments of positive displacement pumps have previously been described. A disadvantage of known positive displacement pumps is that they either are not suitable for high pressures and high volumetric flows or that they are difficult to maintain.

SUMMARY

An aspect of the present invention is to provide a positive displacement pump which is improved at least with regard to one of said disadvantages.

In an embodiment, the present invention provides a positive displacement pump which includes a drive unit and a pump unit. The pump unit comprises at least one inline valve unit, a connecting and/or spacing device, and a pair of flanges which are connected to each other via the connecting and/or spacing device. In an operating position, the at least one inline valve unit is clamped between the pair of flanges. The at least one inline valve unit is configured to be displaced without removing the connecting and/or spacing device.

BRIEF DESCRIPTION OF THE DRAWINGS

The present invention is described in greater detail below on the basis of embodiments and of the drawings in which.

DETAILED DESCRIPTION

Figure 1:
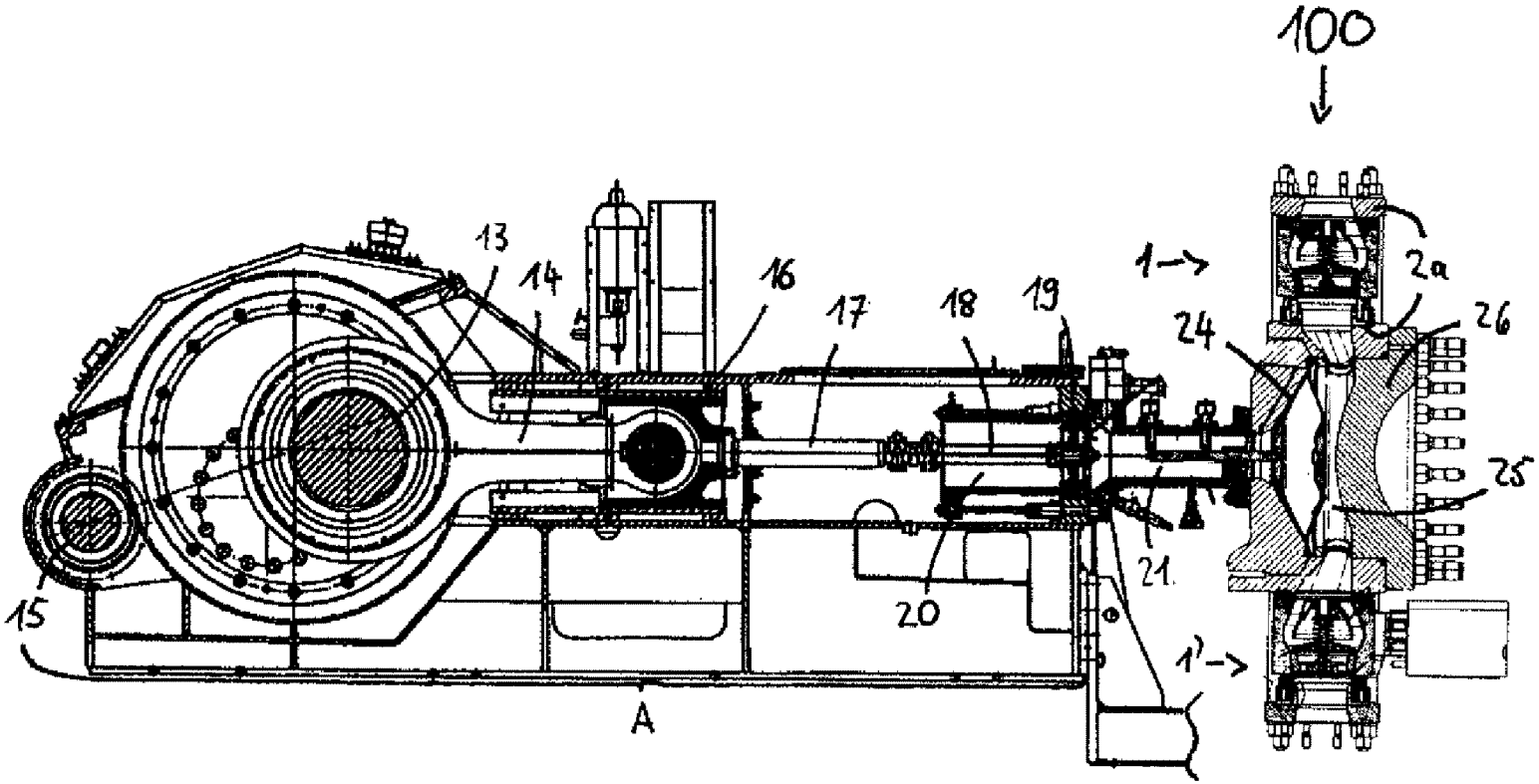
FIG. 1 shows an exemplary positive displacement pump having a drive unit and a pump unit.

The expression "positive displacement pump" as set forth herein in particular designates a pump which has at least one displacement element in at least one working chamber through which a medium is to be pumped, i.e., the conveying medium, flows.

The positive displacement pump according to the present invention has a drive unit. A pump unit is also provided with at least one inline valve unit. Two inline valve units can, for example, be provided per working chamber.

In an operating position, the inline valve unit is clamped between two flanges of the pump unit. This clamping of the valve units between two flanges can also be designated as inter-flange installation.

The flanges are connected to one another via a connecting and/or spacing device, for example, at an unchangeable spacing relative to one another. Therefore, the clamping does not, for example, take place by movement of the flanges towards one another, but, for example, by the parting (in other words: bracing) by a bracing device.

A displacement of the valve unit is possible without removal of a connecting and/or spacing device. For displacement of the inline valve unit, it is thus not necessary for the connection and/or spacing device, via which the flanges are connected to one another, to be removed.

The maintenance of the inline valve unit is therefore considerably simplified and accelerated.

The spacing between two adjacent connection and/or spacing devices can, for example, be greater than the external dimensions, for example, the diameter, of the inline valve unit.

The connecting and/or spacing device can be disposed so that adjacent connecting and/or spacing devices always have the same spacing relative to one another. They can, however, also be arranged so that different spacings are produced between adjacent connection and/or spacing devices.

When the connecting and/or spacing devices are arranged so that at least the greatest spacing (more precisely, the inside width) between two adjacent connecting and/or spacing devices is greater than the external dimensions, for example, the diameter, of the inline valve unit, a prerequisite for relocation of the inline valve unit between two connecting and/or spacing devices is provided without removal thereof.

It has been shown that a resilient connection of the flanges relative to one another and the inline valve units between the flanges is also possible with such a great spacing of the connecting and/or spacing devices.

A valve displacement device can, for example, be provided via which the inline valve unit can be relocated from an operating position into a maintenance position. In connection therewith, the valve unit can, for example, be displaceable on a path of movement which can deviate from a circular path.

The valve displacement device can, for example, be fixedly connected to the rest of the pump.

The inline valve unit can, for example, be exclusively clamped to the flanges. No other fastening device, such as, for example, a screw connection of the valve unit to the flange, is thus, for example, provided. Because the inline valve unit can, for example, be gripped exclusively between the flanges, a prerequisite for a simplified and fast maintenance is provided.

The expression "inline valve unit" as set forth herein designates in particular a valve unit through which the flow passes in a straight line. The expression "flow passes in a straight line" as set forth herein in particular means that the flow direction immediately before the valve corresponds at least approximately to the flow direction immediately after the valve. This distinguishes inline valve units from angle valve units in which the conveying medium enters, for example, on the underside and exits laterally at an angle of 90°. An advantage of inline valve units compared with angle valve units is that a pipe bend which connects the valve unit to the membrane housing can be omitted as are the flow loss associated with the deflection and the dead space volume. There is also no increased wear on angle valve units due to irregular loading.

The flow can, for example, pass through the inline valve units at least approximately vertically. This means in particular that the flow direction immediately before and immediately after the valve unit is at least approximately vertical. It is also conceivable that the flow does not pass through the valve units at least approximately vertically.

The pump can have precisely one or more working chambers. The working chambers may be single-acting or double-acting.

The maintenance of the inline valve units is substantially simplified due to the displacement device since the considerable weight of these units is supported by the valve displacement device and does not have to be held by the technician.

The displacement device can also substantially simplify the maintenance of the inline valve units as it makes the valve units accessible to a crane system.

In the embodiment in which the flow passes vertically through the inline valve units, the two flanges between which the inline valve unit is clamped can, for example, be oriented at least approximately horizontally and can, for example, be disposed precisely one above the other.

In the maintenance position, the inline valve unit can, for example, no longer be disposed between the flanges, but be freely accessible from all sides.

The inline valve unit can also be designated as an inline feed valve unit.

The positive displacement pump can, for example, be a flushing pump for drilling fluid or a so-called "slurry pump," i.e., a pump for transporting solid materials contained in liquid. Slurry pumps are also designated as sludge pumps. Mixtures of liquid and solid constituents are designated as sludges. In an embodiment, the pump generates a pressure of up to 300 bar. The pump can, for example, have a delivery rate of up to 1500 $m^3/h$. The service of the pump can, for example, be more than 500 kW. It is approximately 2400 kW in one embodiment and approximately 5000 kW in another embodiment.

The pump unit can advantageously be a flat membrane pump unit. The displacement element can thus, for example, comprise a flat membrane.

In an embodiment, the membrane can, for example, be disposed vertically in its central position. It is also conceivable, however, that the membrane is not disposed vertically in its central position. This can be provided, for example, by not positioning the pump horizontally.

The displacement element can, for example, be actuated by a working fluid which can in turn, for example, be pressurized by an oscillating piston of a drive unit. In the embodiment in which the pump unit is a flat membrane pump unit, the piston which pressurizes the working fluid is separated completely by the membrane from the liquid to be pumped.

In the embodiment with a flat membrane, the membrane can, for example, be disposed in its central position vertically with respect to the direction of movement of the oscillating piston of the drive unit. It is also conceivable, however, that in its central position, the membrane is not oriented vertically with respect to the direction of movement of the oscillating piston of the drive unit.

The connecting and/or spacing device can, for example, comprise threaded bolts which can, for example, extend through spacer sleeves.

The connecting and/or spacing device can, for example, be disposed so that different spacings are produced between two related connecting and/or spacing devices.

The connecting and/or spacing device can, for example, be disposed so that the greatest spacing between adjacent connecting and/or spacing device is provided in the region of the path of movement of the inline valve unit.

A prerequisite for a compact pump unit is provided when the connecting and/or spacing device is arranged so that the greatest spacing (more precisely, the inside width) between two adjacent connecting and/or spacing devices is only slightly greater than the external dimensions, for example, the diameter, of the inline valve unit. The bending load on the flanges caused by the clamping of the valve units is also reduced compared with an arrangement with adjacent connecting and/or spacing devices with a greater spacing. This also creates a prerequisite for displacement of the inline valve unit between two connecting and/or spacing devices without the removal thereof.

The greatest spacing (more precisely, the inside width) between two adjacent connecting and/or spacing devices may be no more than thirty percent, and in particular no more than ten percent, of the external dimensions of the inline valve unit.

Precisely four connecting and/or spacing devices can, for example, be provided, which are disposed in the shape of a rectangle. A different number of connecting and/or spacing devices is conceivable.

In a conceivable alternative embodiment with the same spacings between two adjacent connecting and/or spacing devices, this spacing can, for example, be slightly greater than the external dimensions, for example, the diameter, of the inline valve unit.

In the embodiment in which the inline valve unit is displaceable via the valve displacement device on a path of movement which deviates from the circular path with a small (greatest) spacing between adjacent connecting and/or spacing devices, a displacement of the inline valve unit from an operating position to a maintenance position can take place via the valve displacement device without removal of a connecting and/or spacing device being necessary.

A maintenance position can also be achieved which is distinguished by a desirably large spacing from the rest of the pump unit without the necessity for an expensive displacement device which itself requires considerable installation space.

In an embodiment, the inline valve unit can be displaced without release of a screw connection on the pump unit (in an embodiment without the hydraulic tensioning device). A screw connection of the hydraulic tensioning device must, for example, always be released for displacement of the inline valve unit.

In an embodiment, the inline valve unit can already be displaced after the release of a threaded element of the clamping device. In order to displace the inline valve unit, only a threaded element of the clamping device, potentially after hydraulic relaxation of the threaded element, and no other threaded element of the rest of the pump, must be released.

In an embodiment, the inline valve unit can be displaced after the release of one single threaded element, for example, a lock nut, of the clamping device.

The maintenance of the inline valve units is thereby simplified and accelerated.

In an embodiment, the valve displacement device can, for example, comprise an inherently articulated jointed arm. The jointed arm can advantageously be mounted on a connecting and/or spacing device. An element which is disposed between the flanges and which only serves to mount the jointed arm on the rest of the pump unit may therefore, for example, be omitted.

The jointed arm can, for example, also be fastened to the inline valve unit in an articulated manner.

It has been shown that a displaceability of the inline valve unit which deviates from a circular path can be achieved simply and reliably with such a jointed arm.

In an embodiment, the inline valve unit can, for example, be displaced on at least parts of a translational movement path. In another embodiment, the inline valve unit can, for example, be displaced exclusively on a translational movement path.

In an embodiment, the valve displacement device can, for example, comprise a telescopic arm.

Even if the valve displacement device comprises lateral telescopic rails, for example, two per inline valve unit, a suitable displaceability of the valve unit, namely, like a drawer, is provided.

It is conceivable that a plurality of valve units and a plurality of displacement devices on one single pair of flanges can be provided. Due to the quick-change system thereby provided, the pump shutdown times caused by the maintenance of the inline valve units are reduced since the inline valve units can be maintained while the inline valve units, which have already been maintained, have been displaced back into an operating position.

At least one inline valve unit can advantageously be clamped between the flanges via a hydraulic gripping device. The clamping can thereby be carried out in a low-torque and precise manner.

The hydraulic gripping device can, for example, adjoin one of the flanges. In particular in the embodiment in which the flanges are disposed precisely one above the other, the hydraulic gripping device can, for example, adjoin the lower flange. The hydraulic gripping device is thus, for example, disposed between the lower flange and the inline valve unit.

If the hydraulic gripping device forms an independent unit which is, for example, not fixedly connected to the pump unit, for example, an adjacent flange, it can then be interchanged or maintained without much expense (for example, replacement of seals).

In the relaxed state, the hydraulic gripping device can, for example, be removed without tools.

An alternative embodiment in which the hydraulic gripping device in the relaxed state cannot be removed without tools is in particular conceivable when the two flanges are not disposed precisely one above the other, but approximately obliquely one above the other or, for example, adjacent to one another. Securing devices can then be provided which fix the hydraulic gripping device against falling out. These securing devices can be configured so that they can only be released with a tool.

In an embodiment, the hydraulic gripping device can, for example have precisely one hydraulic cylinder element.

In an embodiment, the hydraulic cylinder element can, for example, provide precisely one hydraulic cylinder.

In an embodiment, precisely one pressure piston can, for example, be provided.

It is conceivable that the hydraulic gripping device has precisely one annular piston in precisely one annular cylinder.

The hydraulic cylinder element can, for example, provide a plurality of cylindrical hydraulic cylinders. A plurality of individual hydraulic pistons can also advantageously be provided. The individual hydraulic pistons may also be designated as pressure pistons. They can, for example, be cylindrical.

In an embodiment, the hydraulic tensioning device can be double-acting. In this embodiment, the hydraulic piston can thus be selectively pressurized on two different sides of an effective area and can in this way be moved in two directions.

In an embodiment, the hydraulic tensioning device can, for example, be single-acting and the individual pistons are in each case equipped with a piston return spring.

It is conceivable that a plurality of locking elements are provided in order to fix the hydraulic gripping device in the gripped state.

When precisely one lock nut is provided to fix the hydraulic gripping device in the gripped state, a possibility is provided to quickly and resiliently depressurize the hydraulic gripping device while maintaining the gripped status of the inline valve unit.

The present invention will now be explained in greater detail with reference to embodiments illustrated in the drawings.

FIG. 1 shows an exemplary positive displacement pump having a drive unit A and a pump unit 100. The drive unit A comprises a drive shaft 15 which is set in rotation by a motor (not shown in the drawings), for example, an electric motor. At least one gear, which is merely indicated, is disposed on the drive shaft 15 and meshes with at least one substantially greater gear, likewise merely indicated, of the crankshaft 13. The drive shaft 15 can project out of the housing of the drive unit on both sides. A connecting rod 14 is disposed on the crankshaft 13. The connecting rod 14 is mounted on the crankshaft 13 with the aid of a big end bearing which is designed as an anti-friction bearing.

The connecting rod 14 transmits its motion via a cross head 16 on a cross head rod 17 which merges into the piston rod 18. The cross head bearing is likewise an anti-friction bearing. The cross head 16 also comprises sliding shoes which serve for linear mounting thereof on the plain bearing walls. A working medium piston 19 is disposed on the piston rod 18 and performs an oscillating movement in a straight line in a working medium cylinder 20.

A pump unit 100 is provided on the drive unit A. The pump unit 100 provides a working medium chamber which adjoins the working medium cylinder 20 and in which the working medium 21, for example, hydraulic oil, is provided which transmits the motion of the working medium piston 19 to a flat membrane 24. The flat membrane 24 is illustrated in FIG. 1 in its two extreme positions. The flat membrane 24, together with a part of the membrane housing 26, forms a working chamber 25. The working chamber 25 is connected via non-return valves in inline valve units 1, 1' to a discharge and intake pipe which is not shown in FIG. 1.

A rotary movement of the crankshaft 13 results in working medium being moved to and fro in the working chamber 25 and the flat membrane 24 is thereby deflected alternately to the right and left. The deflection to the left in FIG. 1 leads to closing of the outlet non-return valve or discharge valve and to intake of conveying medium through the opened inlet non-return valve or intake valve. The subsequent displacement of the piston rod 18 according to FIG. 1 towards the right leads to closing of the inlet non-return valve and dispensing of a volume of conveying medium corresponding to the cylinder capacity or displaced piston volume by means of the now-opened outlet non-return valve and the relocation of the flat membrane 24 towards the right with reference to FIG. 1. In the pump shown in FIG. 1, three connecting rods 14, working medium cylinders 20, and pump units 100 can be disposed adjacent to one another. This may thus be a triplex pump with three working chambers 25. More or fewer, for instance precisely two, connecting rods 14, working medium cylinders 20 and pump units 100 can be disposed adjacent to one another.

Two inline valve units 1, 1' are provided per working chamber 25.

Conveying medium flows in a straight line through the inline valve units 1, 1'. The flow direction immediately before the valve thus corresponds at least approximately to the flow direction immediately after the valve. There is no change of direction of the conveying medium in the region of these valves.

Figure 2:
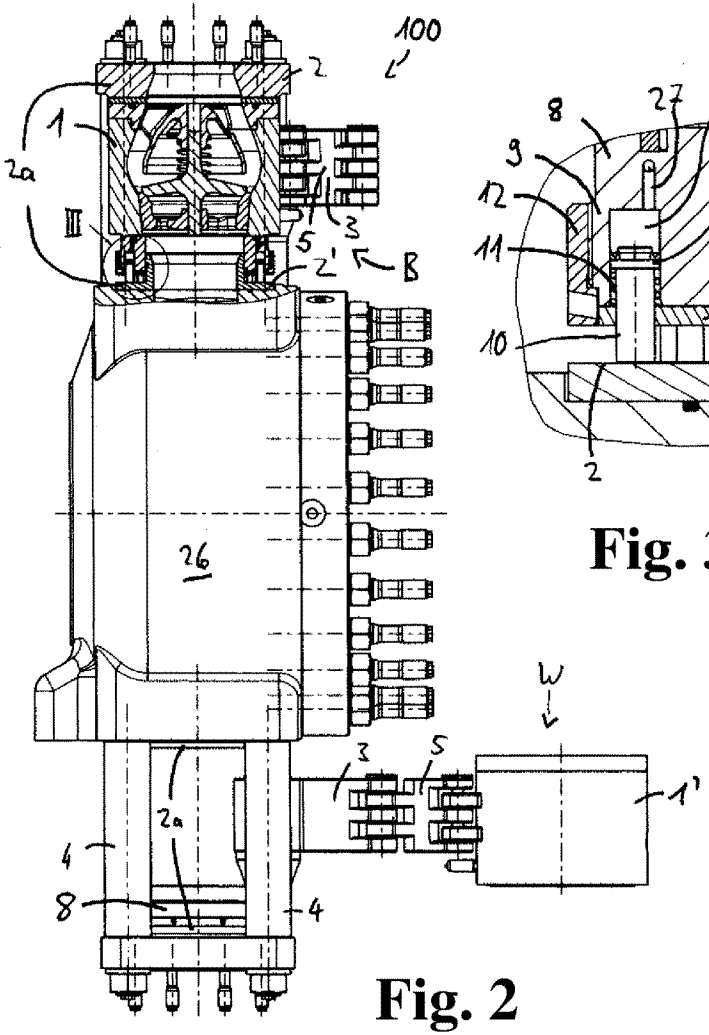
FIG. 2 shows a partially cutaway side view of a pump unit with an upper inline valve unit in the operating position and a lower inline valve unit in the maintenance position, wherein the valve displacement device is designed as a jointed arm.

FIG. 2 shows, for example, that in the operating position, each inline valve unit 1, 1' is clamped between two flanges 2, 2'. Two flanges 2, 2', which are disposed parallel to and spaced apart from one another, thus form a pair of flanges 2*a* between which the inline valve unit 1, 1' is clamped. FIG. 2 also shows that a valve displacement device 3 is provided which is connected fixedly to the rest of the pump and via which each inline valve unit 1, 1' can be displaced from an operating position B, in which the inline valve unit 1 is clamped between the pair of flanges 2*a*, to a maintenance position W, in which the inline valve unit 1' is not disposed between the pair of flanges 2*a*.

Figure 4:
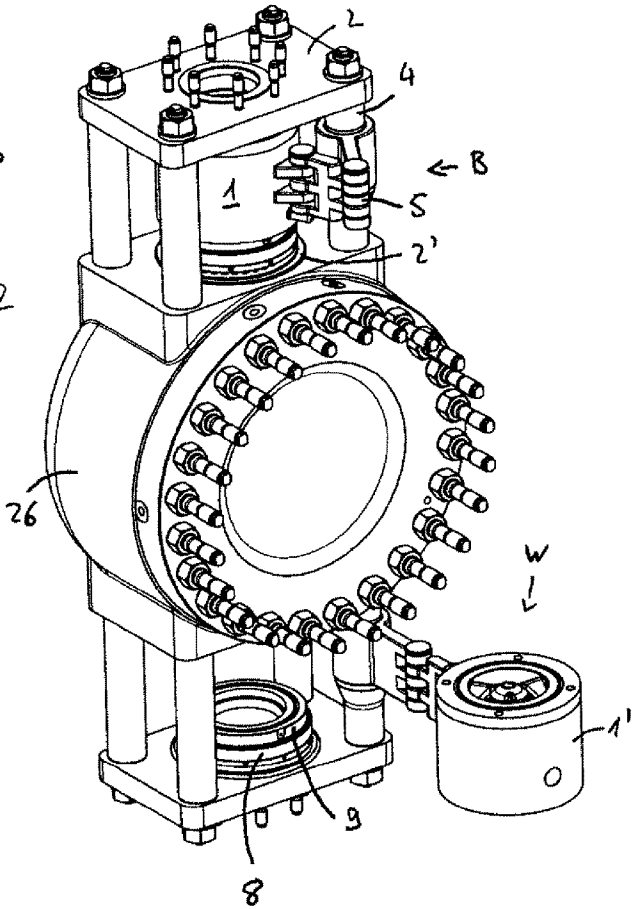
FIG. 4 shows a perspective representation of the pump unit shown in FIG. 2.

FIGS. 2 and 4 show, for example, that the flanges 2, 2' in all illustrated exemplary embodiments are connected to one another via connecting and/or spacing devices 4. The connecting and/or spacing devices 4 in all illustrated exemplary embodiments are designed as connecting and/or spacing device 4 which connect the flanges 2, 2' fixedly to one another with a predetermined, unchangeable spacing. As connecting devices, the connecting and/or spacing devices 4 in all illustrated exemplary embodiments have threaded bolts screwed to the flanges 2, 2' via nuts. As spacing devices, the connecting and/or spacing devices 4 have spacer sleeves which are disposed between the flanges 2, 2' and through which the threaded bolts pass.

Figure 7:
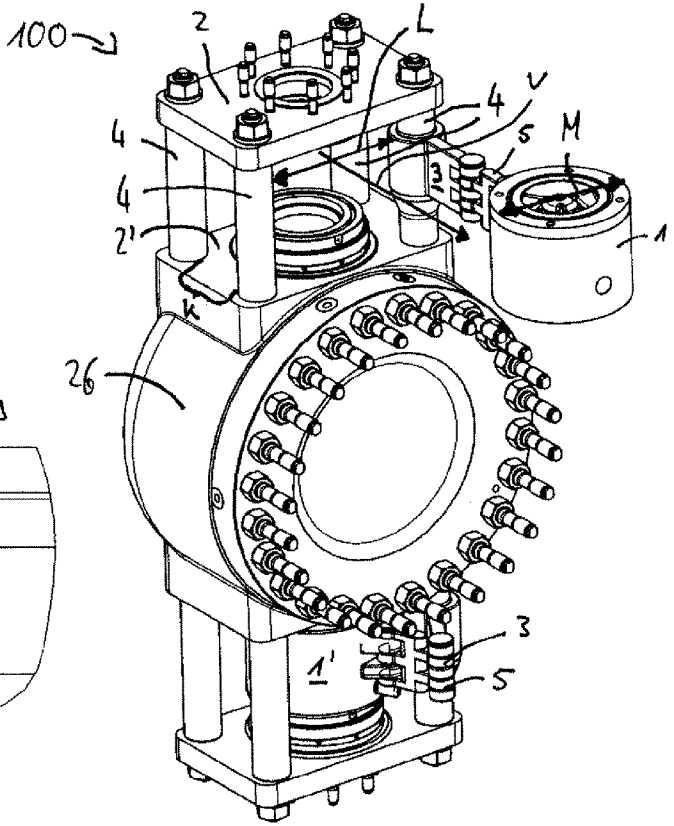
FIG. 7 shows a perspective representation of the pump unit shown in FIG. 5.
Figure 6:
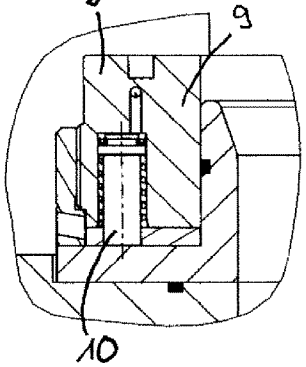
FIG. 6 shows an enlarged detail from FIG. 5.
Figure 5:
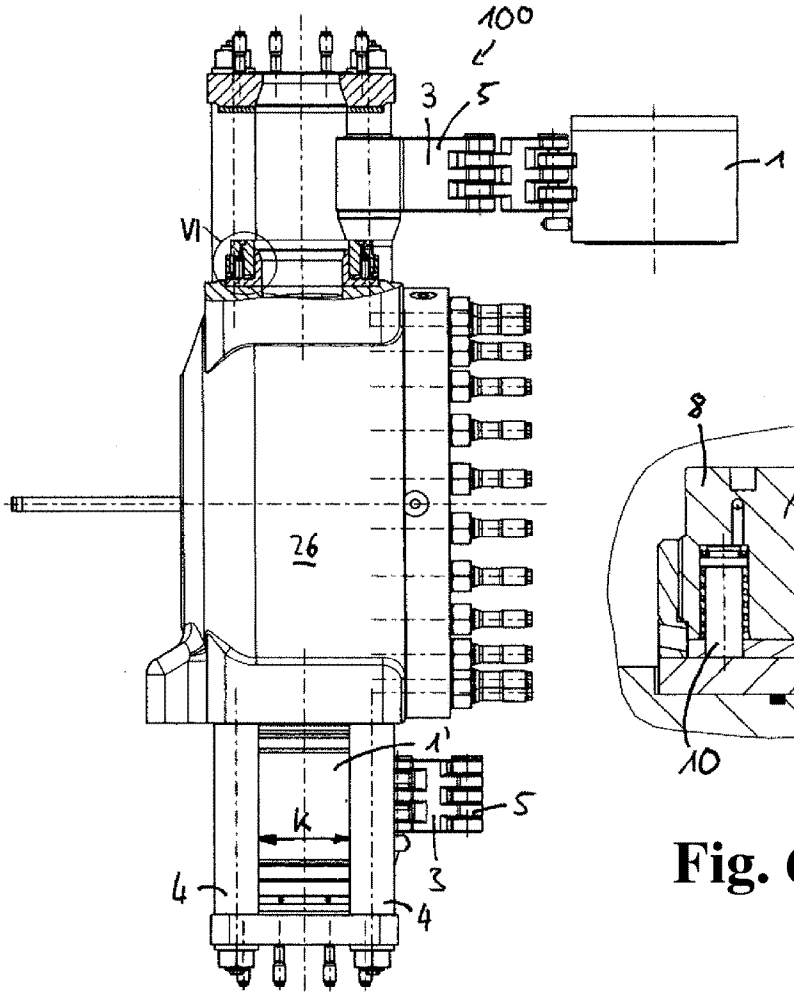
FIG. 5 shows a side view of the pump unit shown in FIG. 2 with an upper inline valve unit in the maintenance position and a lower inline valve unit in the operating position.

FIG. 7 shows, for example, that four connecting and/or spacing devices 4 disposed in the form of a rectangle are provided per valve unit 1, 1'. Two different spacings K, L are therefore produced between adjacent connecting and/or spacing devices 4. It can also be seen from this drawing that the connecting and/or spacing devices 4 are disposed so that the greater of the two spacings L extends perpendicular to the displacement direction V of the inline valve unit 1, 1' and is slightly greater than the external dimensions M of the inline valve unit 1. The larger spacing L between two adjacent connecting and/or spacing devices 4 is thus provided in the region of the path of movement of the inline valve unit 1, 1'. The smaller spacing K extending perpendicular thereto between two adjacent connecting and/or spacing devices 4 can be smaller than the external dimensions M of the inline valve unit 1 (FIG. 5).

At the same time, the displacement direction V symbolizes a path of movement of an inline valve unit 1. This deviates from a circular path. At least parts of this path can be straight as is shown in FIG. 7.

Due to the small spacing between the connecting and/or spacing devices 4, a compact construction is achieved and the bending load on the flanges 2, 2' is reduced. Since at least parts of the path of movement of the inline valve units 1, 1' are straight, said units can nevertheless be moved out between two connecting and/or spacing devices 4 without it being necessary to remove connecting and/or spacing devices 4.

In the exemplary embodiment shown in FIGS. 2 to 7, the valve displacement device 3 comprises an inherently articulated jointed arm 5.

Figure 10:
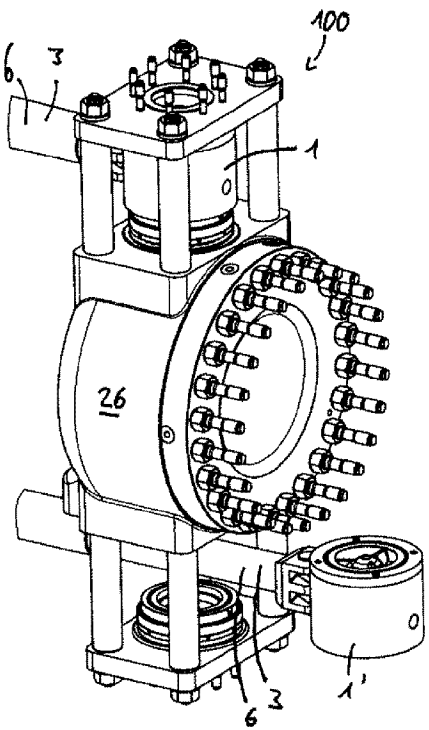
FIG. 10 shows a perspective representation of the pump unit shown in FIG. 8.
Figure 9:
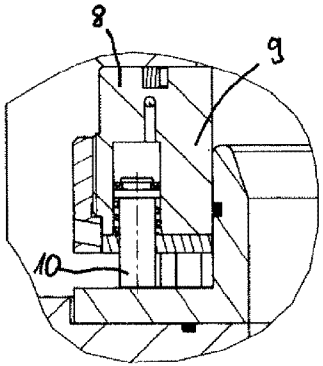
FIG. 9 shows an enlarged detail from FIG. 8.
Figure 8:
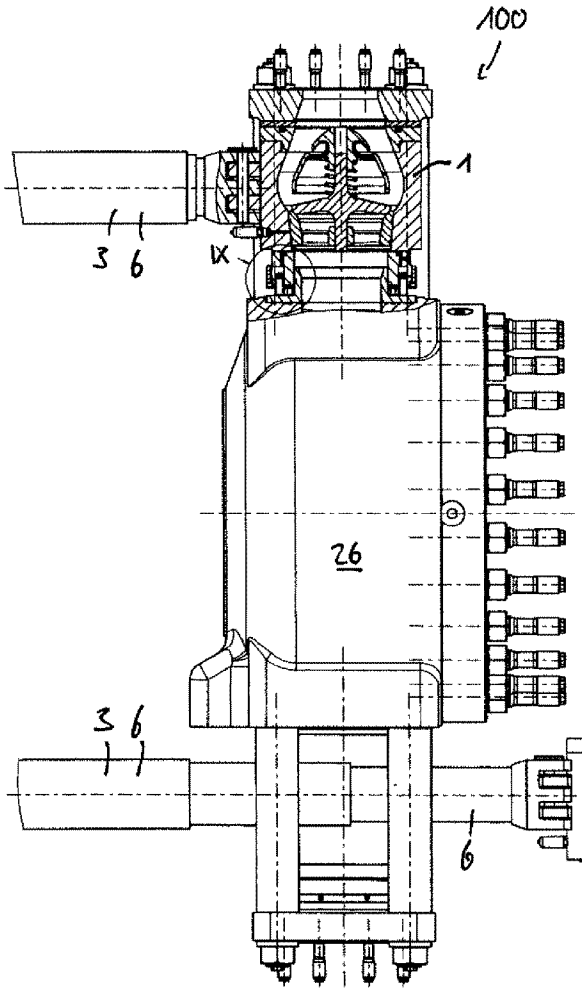
FIG. 8 shows a partially cutaway side view of a pump unit with telescopic arms.

In comparison, in the exemplary embodiment shown in FIGS. 8 to 10, the valve displacement device 3 comprises a telescopic arm 6.

Figure 12:
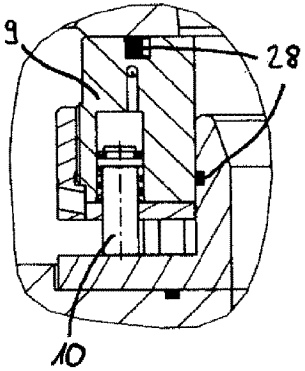
FIG. 12 shows a detail from FIG. 11.
Figure 13:
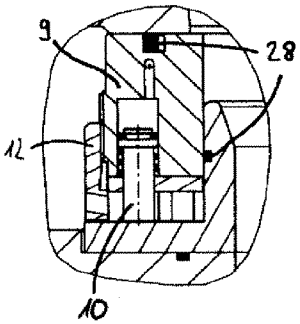
FIG. 13 shows a view as in FIG. 12 but on a smaller scale and with a hydraulic cylinder element fixed by the lock nut.
Figure 11:
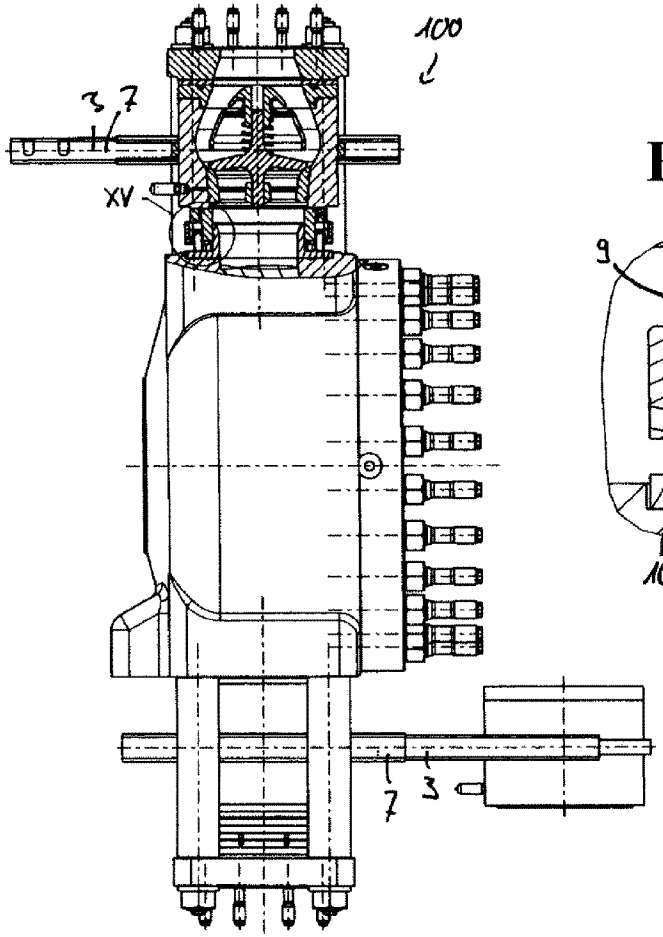
FIG. 11 shows a partially cutaway side view of a pump unit in which each valve displacement device comprises two telescopic rails.

In the exemplary embodiment shown in FIGS. 11 to 13, the valve displacement device 3 comprises two telescopic rails 7, 7'.

Figure 14:
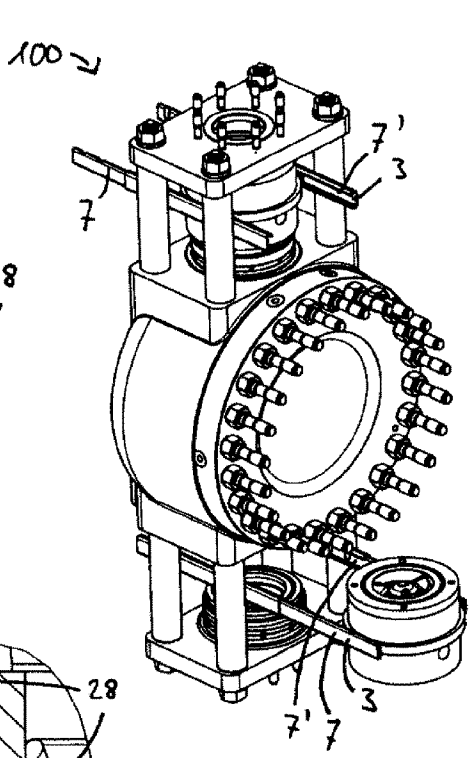
FIG. 14 shows a perspective representation of the pump unit shown in FIG. 11.
Figure 16:
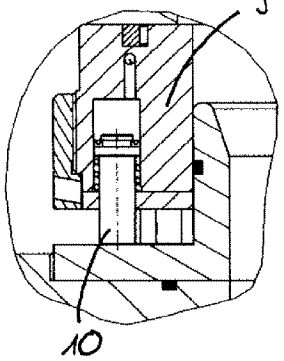
FIG. 16 shows a detail from FIG. 14.
Figure 15:
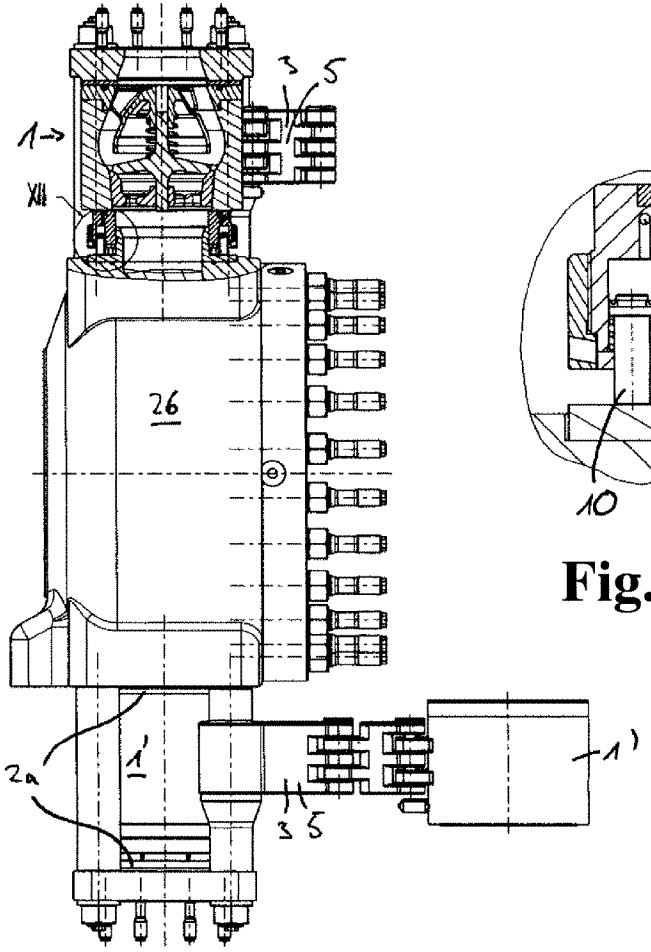
FIG. 15 shows a partially cutaway side view of a pump unit in which a plurality of valve units and a plurality of relocation devices are disposed on each pair of flanges.

In the exemplary embodiment shown in FIGS. 14 to 16, a plurality of inline valve units 1, 1', namely, two inline valve units 1, 1', and a plurality of valve displacement devices 3, namely, two valve displacement devices 3, are provided on each pair of flanges 2*a*. In this exemplary embodiment, as in the exemplary embodiment shown in FIGS. 2 to 7, the valve displacement device 3 comprises a jointed arm 5.

In all shown exemplary embodiments, the inline valve units 1, 1' are in each case exclusively clamped via a hydraulic gripping device 8 between the flanges 2, 2'.

Figure 3:
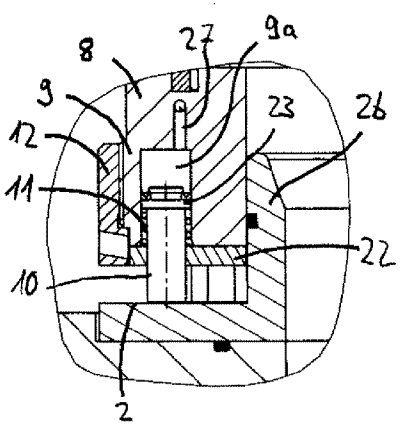
FIG. 3 shows an enlarged detail from FIG. 2.

FIG. 3 shows, for example, that the hydraulic gripping device 8 forms an independent unit which is not fixedly connected to the pump unit 100, for example, the adjoining lower flange 2. It is tool-free in the relaxed state, i.e., it can be removed without the aid of tools. The hydraulic gripping device 8 has a hydraulic cylinder element 9 which is annular and in which a plurality of cylindrical bores 9*a* are disposed. FIG. 3 also shows that the flange 2 on which the hydraulic gripping device 8 is disposed has an annular projection 2*b*. The external diameter of the annular projection 2*b* is slightly less than the internal diameter of the hydraulic cylinder element 9 so that the hydraulic cylinder element 9 is guided and simultaneously centered on annular projection 2*b* of the flange 2 via a linear sliding bearing.

Figure 18:
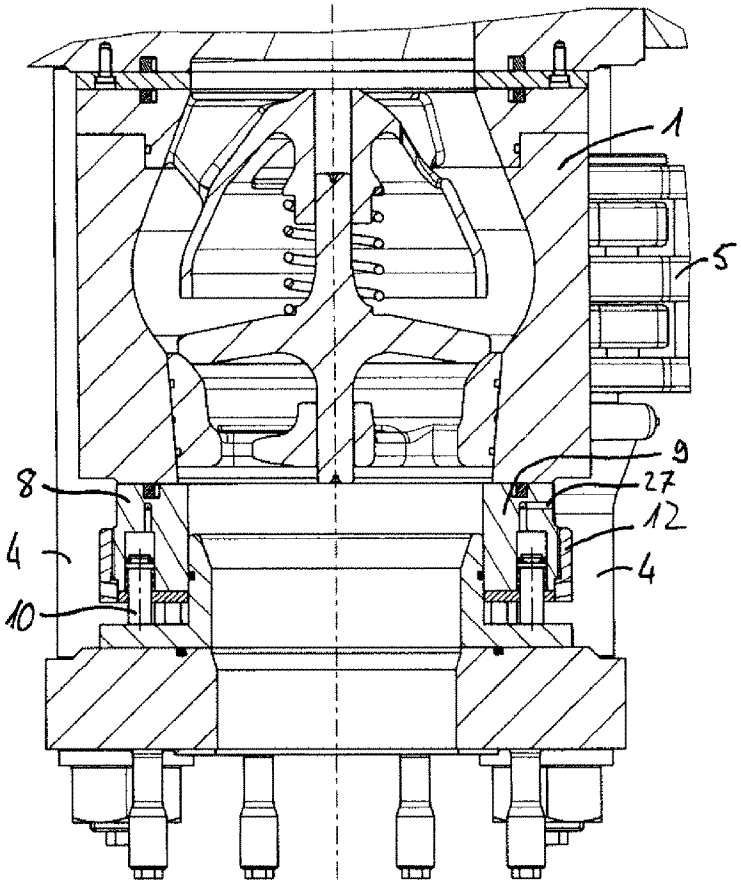
FIG. 18 shows a cut-away representation of an inline valve unit in the gripped state.

A cylindrical individual hydraulic piston 10 is disposed in each cylindrical bore 9*a*. Each individual hydraulic piston 10 has a piston collar 23. Above the piston collar 23, each cylindrical bore 9*a* can be filled with pressure fluid through a hydraulic line 27 and can be pressurized. The hydraulic cylinder element 9 is then raised and thereby grips the inline valve unit 1, 1'. In this case, the hydraulic cylinder element 9 is supported via the pressure fluid on the individual hydraulic pistons 10 which in turn are supported on the flange 2. This gripped state of the hydraulic gripping device 8 is shown, for example, in FIG. 3. The lock nut 12 can then be screwed down until it is likewise supported on the lower flange 2 (only shown in FIG. 13). The hydraulic cylinder element 9 is thereby fixed and the hydraulic system of the hydraulic gripping device 8 can be relieved. The inline valve unit 1 is thereby gripped securely between the pair of flanges 2*a*. FIG. 18 also shows this state, wherein the lock nut 12 is also not screwed down in FIG. 18.

Figure 17:
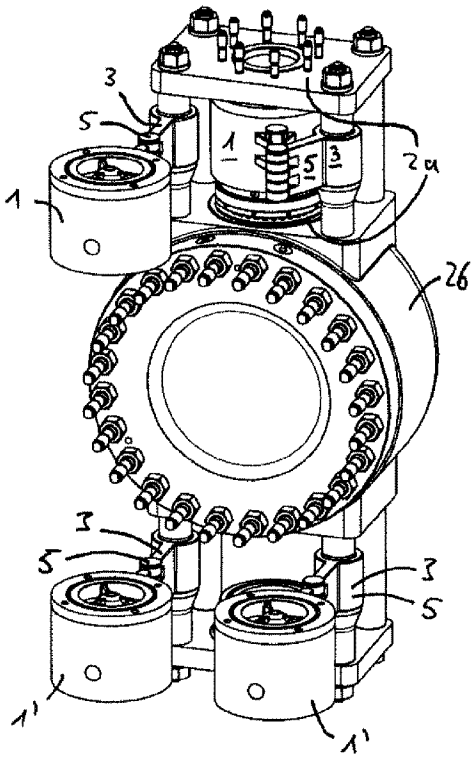
FIG. 17 shows a perspective representation of a pump unit in which a plurality of valve units and a plurality of displacement devices are provided on each pair of flanges, wherein one upper valve unit is in the operating position, one upper valve unit is in the maintenance position, and both lower valve units are in the maintenance position.

As shown, for example, in FIGS. 17 and 18, the individual hydraulic pistons 10 are directed away from the respective inline valve unit 1, 1' and the hydraulic cylinder element 9 faces the inline valve unit 1, 1' and is in contact therewith. An arrangement is conceivable which is rotated by 180° and in which the individual hydraulic pistons 10 face the respective inline valve unit 1, 1' and the hydraulic cylinder element 9 is directed away from the inline valve unit 1, 1'.

Figure 19:
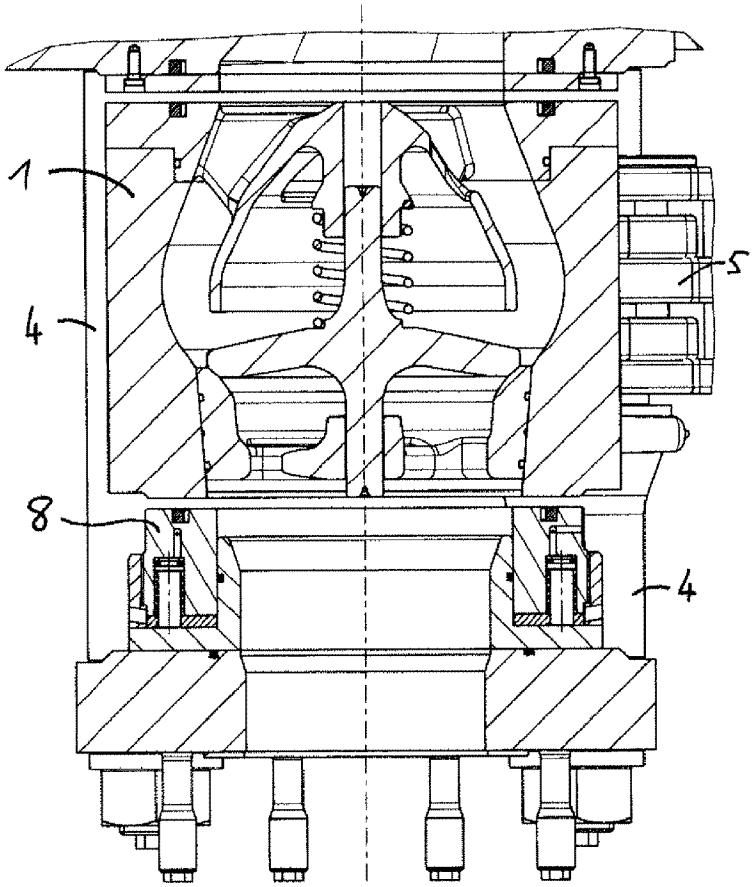
FIG. 19 shows a cut-away representation of an inline valve unit in the ungripped state.

For relaxation of the hydraulic gripping device 8, in order to be able to displace and maintain the inline valve unit 1, 1', at the outset the pressure fluid of the hydraulic gripping device 8 is again pressurized. The lock nut 12 can then be slightly released. If the pressure of the hydraulic fluid is then reduced in the cylinder bore, a piston return spring 11 then disposed between the piston collar 23 of the piston 10 and a hydraulic cylinder element collar 22 of the hydraulic cylinder element 9 provides that the pistons 10 are displaced into the hydraulic cylinder element 9, as is shown in FIG. 19. In the ungripped state shown there of the hydraulic gripping device 8, the inline valve unit 1 can be displaced. There is no return connection between the hydraulic cylinder element 9 and the flange 2 adjoining the hydraulic gripping device 8.

The hydraulic gripping device 8 has seals 28 for sealing against conveying fluid (FIG. 12).

The present invention is not limited to embodiments described herein; reference should be had to the appended claims.

LIST OF REFERENCE NUMERALS

100 pump unit
1, 1' inline valve unit
2, 2' flange
2*a* pair of flanges
2*b* annular projection
3 valve displacement device
4 connecting and/or spacing device
5 inherently articulated jointed arm
6 telescopic arm
7, 7' telescopic rails
8 hydraulic gripping device
9 hydraulic cylinder element
9*a* cylinder bores
10 individual hydraulic piston
11 piston return spring
12 lock nut
13 crankshaft
14 connecting rod
15 drive shaft
16 cross head
17 cross head rod
18 piston rod
19 working medium piston
20 working medium cylinder
21 working medium
22 hydraulic cylinder element collar
23 piston collar
24 flat membrane
25 working chamber
26 membrane housing
27 hydraulic lines
28 seals
A drive unit
B operating position
K smaller spacing
L inside width and larger spacing
M external dimensions
W maintenance position
V displacement direction

What is claimed is:

1. A positive displacement pump comprising:
a drive unit; and
a pump unit comprising,
at least one inline valve unit comprising an external dimension,
four connecting and/or spacing devices, the four connecting and/or spacing devices being arranged in a rectangular shape so that a spacing exists between any two of the four connecting and/or spacing devices, and
a pair of flanges which are connected to each other via the four connecting and/or spacing devices,
wherein,
in an operating position, the at least one inline valve unit is clamped between the pair of flanges,
the at least one inline valve unit is configured to be displaced without removing any of the four connecting and/or spacing devices and without changing a spacing between the pair of flanges and the four connecting and/or spacing devices, and
the spacing between at least two of the four connecting and/or spacing devices is greater than the external dimension of the at least one inline valve unit.

2. The positive displacement pump as recited in claim 1, wherein the pump unit is a flat membrane pump unit.

3. The positive displacement pump as recited in claim 1, further comprising:
a valve displacement device configured to displace the at least one inline valve unit out of the operating position into a maintenance position,
wherein, the at least one inline valve unit is configured to be displaced on a path of movement which deviates from a circular path.

4. The positive displacement pump as recited in claim 3, wherein the valve displacement device comprises an inherently articulated jointed arm.

5. The positive displacement pump as recited in claim 3, wherein the valve displacement device comprises a telescopic arm.

6. The positive displacement pump as recited in claim 3, wherein the valve displacement device comprises two telescopic rails.

7. The positive displacement pump as recited in claim 3, wherein, a plurality of inline valve units are provided on the pair of flanges, and a plurality of valve displacement devices are provided on the pair of flanges.

8. The positive displacement pump as recited in claim 1, further comprising:

a hydraulic gripping device provided as an independent unit which is not fixedly connected to the pump unit, the hydraulic gripping device being configured to grip the at least one inline valve unit between the pair of flanges.

9. The positive displacement pump as recited in claim 8, wherein the hydraulic gripping device comprises a hydraulic cylinder element and a plurality of individual hydraulic pistons.

10. The positive displacement pump as recited in claim 9, wherein the hydraulic gripping device is configured to be double-acting.

11. The positive displacement pump as recited in claim 9, wherein the plurality of individual hydraulic pistons are provided with a piston return spring and one lock nut which is configured to fix the hydraulic gripping device in a gripped state.

* * * * *